US005172648A

United States Patent [19]

Isham

[11] Patent Number: 5,172,648

[45] Date of Patent: Dec. 22, 1992

[54] STEERING MECHANISM FOR A BOAT

[76] Inventor: George Isham, 111 Garretson Ave., Rodeo, Calif. 94572

[21] Appl. No.: 623,519

[22] Filed: Dec. 7, 1990

[51] Int. Cl.[5] ..... B63H 25/06

[52] U.S. Cl. ..... 114/162

[58] Field of Search ..... 114/162, 39.1, 163, 114/164, 140-143; 440/15

[56] References Cited

U.S. PATENT DOCUMENTS

| | | | |
|---|---|---|---|
| 59,296 | 10/1866 | Wappich | 114/162 |
| 144,538 | 11/1873 | Harsen | 440/15 |
| 427,845 | 5/1980 | Garcia-Sanchez | 114/162 |
| 779,961 | 1/1905 | Nicholson | 114/162 |
| 1,973,783 | 9/1934 | Thorsen | 114/162 |
| 4,074,646 | 2/1978 | Dorfman et al. | 114/162 |

FOREIGN PATENT DOCUMENTS

| | | | |
|---|---|---|---|
| 2030097 | 4/1980 | United Kingdom | 114/162 |

*Primary Examiner*—Jesûs D. Sotelo
*Assistant Examiner*—Stephen P. Avila
*Attorney, Agent, or Firm*—Bielen, Peterson & Lampe

[57] ABSTRACT

A steering mechanism for a boat utilizing a hull which is provided with a rudder apparatus. The rudder apparatus has an end portion extending outwardly from the boat hull with top and bottom portions. The rudder apparatus may be turned or flipped transversely relative to the boat hull and/or twisted such that the top portion of the rudder apparatus and the bottom portion of the rudder apparatus are moved transversely and oppositely relative to one another.

13 Claims, 4 Drawing Sheets

STEERING MECHANISM FOR A BOAT

BACKGROUND OF THE INVENTION

The present invention relates to a novel steering mechanism for a boat.

Boats such as sail boats are often difficult to maneuver unless they are heavily ballasted. Unfortunately, ballasting also slows the speed of such a vessel and causes the steering of the boat to become sluggish. On the other hand, high profile boats with reduced ballast although quite agile, are often difficult to steer in moderate winds since the high freeboard side of the hull acts as a sail which tends to push the boat off course. Moreover, present boat designs permit excessive pitching in moderate seas.

A boat steering mechanism which solves many of the above identified problems found in the prior art would be a great advance in marine industry.

SUMMARY OF THE INVENTION

In accordance with the present invention a novel and useful steering mechanism for a boat is herein provided.

The mechanism of the present invention utilizes a rudder apparatus which is connected to a boat hull and serves as an extension of the same. The hull may be of a conventional design. The rudder apparatus includes an end portion which extends outwardly from the boat hull, a top portion, and a bottom portion. Such rudder apparatus may be composed of a plurality of flexible strakes adjacent one another to form a first side portion of the rudder apparatus. Similar arrangement of flexible strakes form the second side portion of the rudder apparatus. The first and second side portions which have a section lying in close proximity to one another to form the end portion of the rudder apparatus. A plate may be formed intermediate the first and second side portions and be capable of bearing on thereupon.

Means is provided for turning or flipping the end portion of the rudder apparatus transversely relative to the boat hull. Such means may take the form of an elongated shaft and means for pivoting the elongated shaft transversely relative to the boat hull. Such elongated shaft may be connected to the plate between the sections of the first and second side portions, hereinbefore described. A plurality of fins may be interposed the plurality of adjacent flexible strakes and extend outwardly from the same. Such fins would aid in the stabilization of the rudder apparatus during turning of the boat. The rudder apparatus may also be constructed such that a chamber is formed within the top and bottom portions and the side portions thereof.

Further, the elongated shaft may be an articulated member having a first portion and also including a second portion which is rotatable relative to the first portion of the articulated shaft. The second portion is also rotatable transversely relative to the boat hull. Such means for turning the end portion of the rudder apparatus may lie within the chamber of the rudder apparatus to a very large degree.

The invention also includes means for turning the top portion of the rudder apparatus transversely and turning the bottom portion of the rudder apparatus transversely, but in a direction opposite the transverse turning of the rudder apparatus. Such means effectively twists the rudder apparatus about a longitudinal axis which extends along the hull portion of the boat. Such twisting may take the form of elongated shaft which is connected to the mid point of the plate interposed the side portions of the rudder apparatus. Means is also included for rotating the plate and elongated shaft about the dimension of elongation of the shaft. The shaft associated with the twisting motion of the rudder apparatus may be the same shaft which is articulated for transverse movement of the end portion of the rudder apparatus. Thus, it may be understood that the shaft associated with turning and twisting of the rudder apparatus is capable of pivoting or rotating along orthogonal axes.

It should be noted that the means for turning the rudder apparatus and means for twisting the rudder apparatus be at least partially located within chamber formed by the rudder apparatus itself. Of course, controls to effect such turning and twisting the rudder apparatus would extend outside such chamber onto the back portions of the boat hull.

The chamber formed within the rudder apparatus may be pervious to water and yet obtain floatation from material placed within the chamber for that purpose. Thus, a boat having the rudder apparatus of the present invention would lie or sit low in the water and yet be capable of achieving a high degree of steering control despite a strong force of the wind acting on the boat.

It may be apparent that a novel and useful steering mechanism for a boat has been described.

It is therefore an object of the present invention to provide a steering mechanism for a boat which achieves a high degree of heeling attenuation.

Another object of the present invention is to provide a steering mechanism for a boat which permits the boat to possess a low profile in the water which reduces yawing due to wave action.

A further object of the present invention to provide a novel steering mechanism for a boat which eliminates pitching action caused by water movement.

Yet another object of the present invention is to provide a steering mechanism for a boat which possesses a high degree of momentum which tends to cause the boat to complete turns against the force of the wind.

A further object of the present invention is to provide a steering mechanism for the boat with a novel rudder apparatus which achieves a shifting of weight to counteract heeling tendencies caused by wind and weight action.

The invention possesses other objects and advantages especially as concerns particular characteristics and features thereof which will become apparent as the specification continues.

Figure 2:
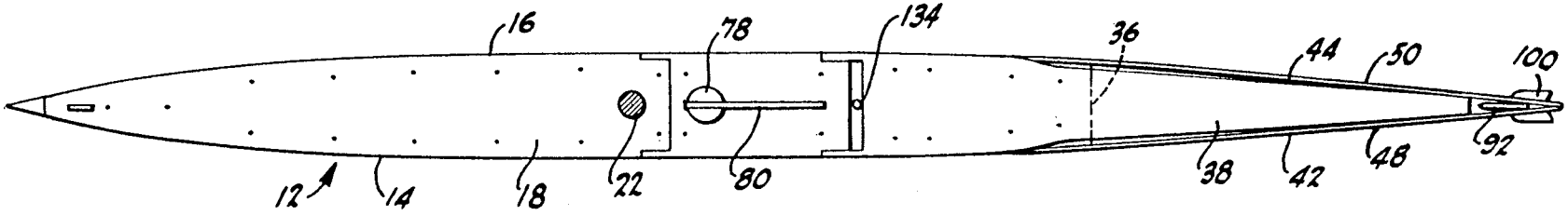
FIG. 2 is a sectional view taken along line 2—2 of FIG. 1.

For a better understanding of the invention reference is made to the following detailed description of the preferred embodiments of which should be referenced to the hereinabove described drawings.

DESCRIPTION OF THE PREFERRED EMBODIMENTS

Various aspects of the present invention will evolve from the following description of the preferred embodiments which should be taken in conjunction with the prior described drawings.

The invention as a whole is depicted in the drawings by reference character 10. The steering mechanism 10 which is employed in conjunction with a boat hull 12 which may be of conventional construction and include water tight side portions 14 and 16 capped by a deck 18. Hull 12 and steering mechanism 10 are formed into a sail boat structure 20 including a mast 22, boom 24, keel 26, and plurality of stays 28. Jib 30 and mainsail 32 are also partially depicted in the drawings, FIGS. 1 and 2 in particular. It should be noted that the steering mechanism 10 of the present invention may be employed with other vessels such as motorboats.

Steering mechanism 10 includes as one of its elements rudder apparatus 34 which is attached to hull 12 at bulkhead 36 and extends outwardly from hull 12. Rudder apparatus includes a top portion 38, bottom portion 40, and side portions 42 and 44, FIGS. 1 and 2. A chamber 46 is formed within rudder apparatus 34, FIG. 9, which will be discussed in greater detail hereinafter.

Figure 1:
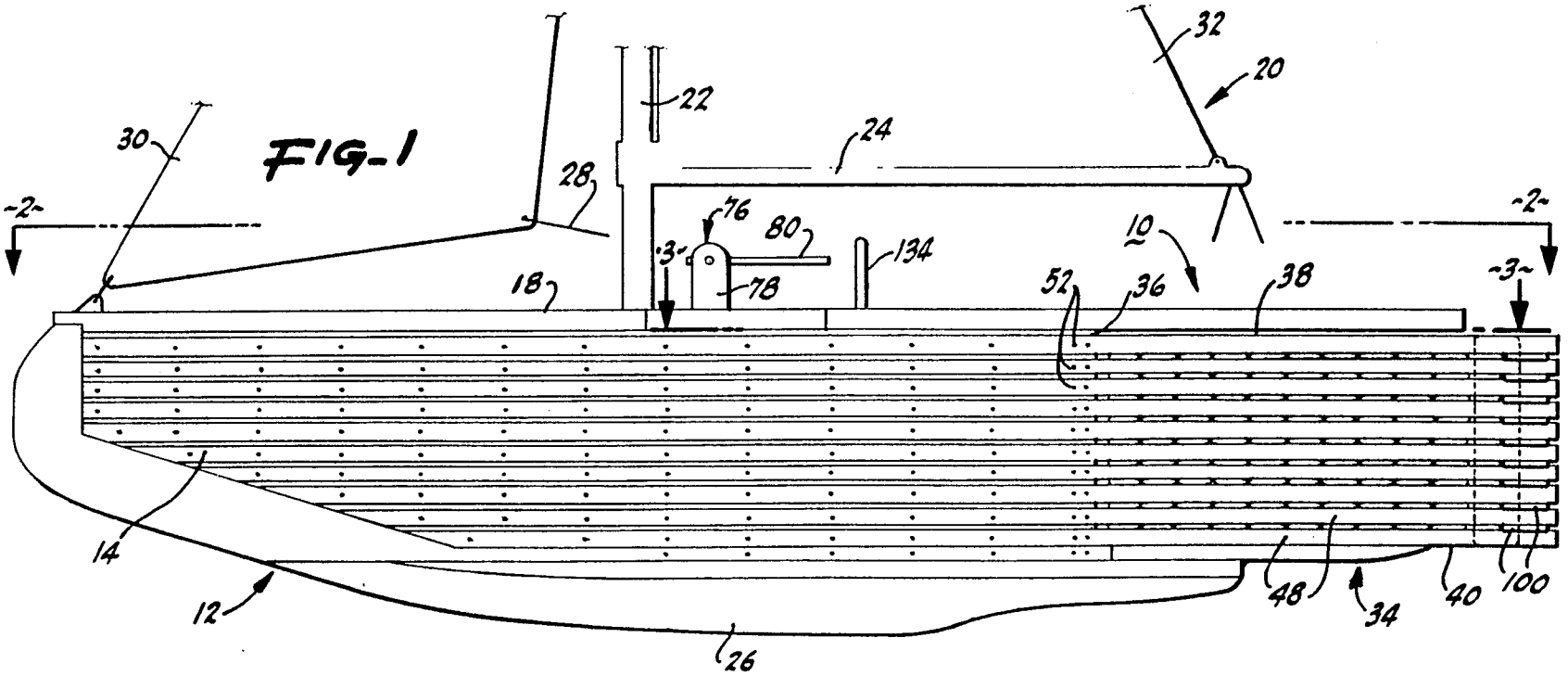
FIG. 1 is a side elevational view of the mechanism of the present invention on a sail boat.
Figures 3, 4, 5, 6:
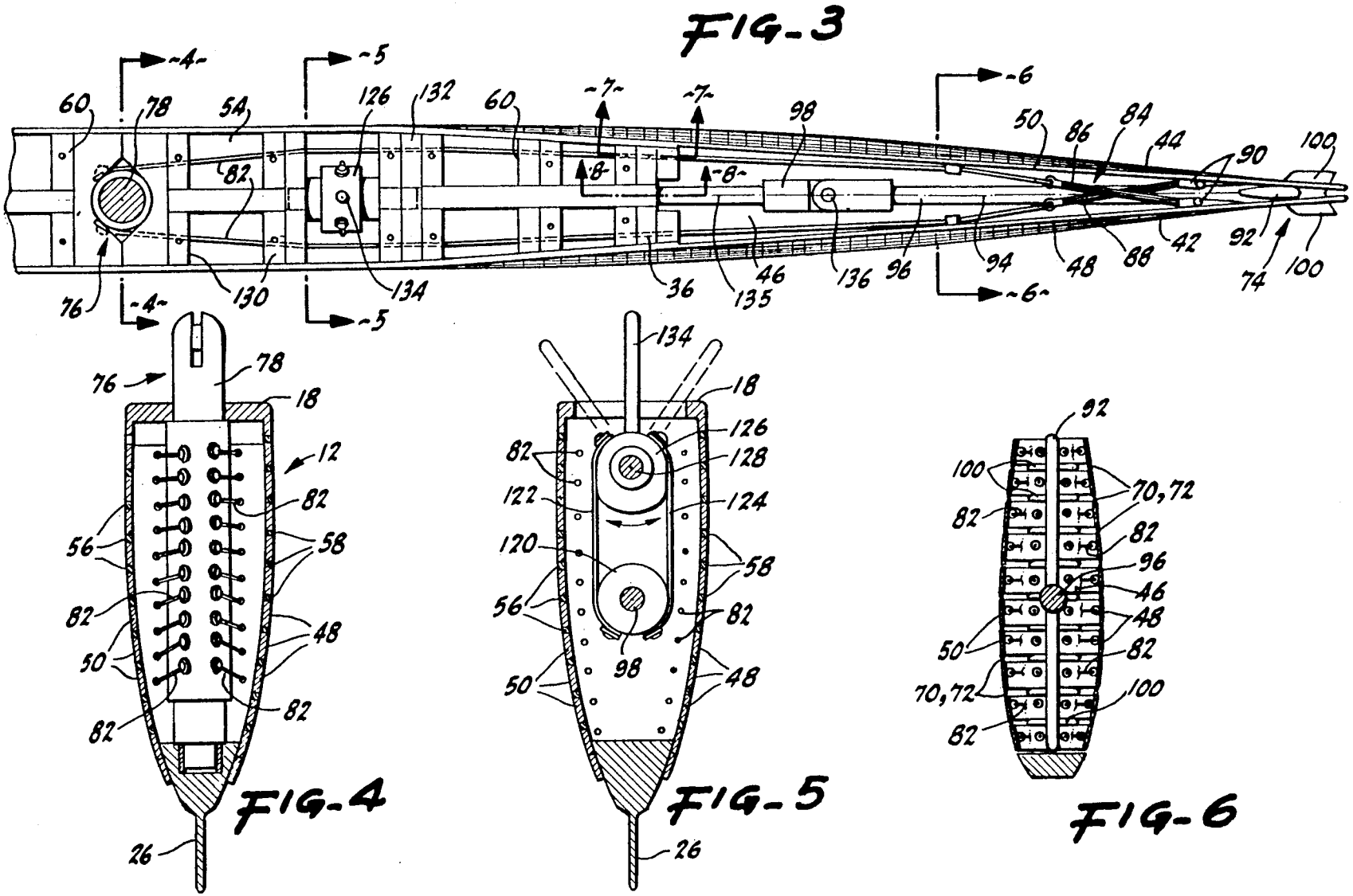
FIG. 3 is a sectional view taken along line 3—3 of FIG. 1 focusing on the rudder apparatus of the steering mechanism of the present invention.
FIG. 4 is a sectional view taken along line 4—4 of FIG. 3.
FIG. 5 is a sectional view taken along line 5—5 of FIG. 3.
FIG. 6 is a sectional view taken along line 6—6 of FIG. 3.

Rudder apparatus 10 includes a plurality of flexible strakes 48 and 50 which form side portions 42 and 44 of rudder apparatus 34, FIGS. 1, 2 and 3. Such plurality of flexible strakes 48 and 50 are fastened to bulkhead 36 by plurality of fasteners 52, FIGS. 1 and 9, and another similar plurality of fasteners along side portion 44 (not shown), respectively. It should be noted that plurality of strakes 48 and 50 extend over hull 12 but form a water tight hull compartment 54 by the use of plurality of caulking strips 56 and 58 respectively, FIGS. 4 and 5. Plurality of fasteners 56 connect plurality of strakes 48 and 50 to multiplicity of bulk heads 58 within compartment 54, FIGS. 1 and 3. In contrast, compartment 46 is pervious to water since water is free to enter the gaps between adjacent strakes forming rudder apparatus 34.

Figure 10:
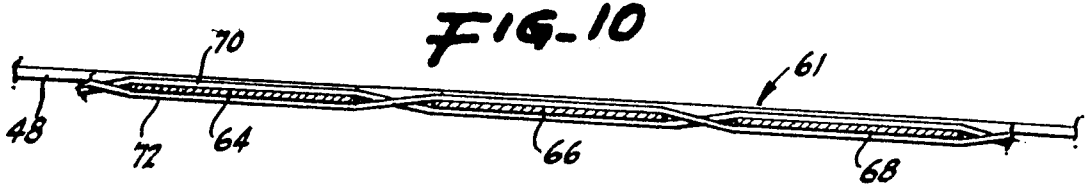
FIG. 10 is a sectional view taken along line 10—10 of FIG. 9.
Figure 9:
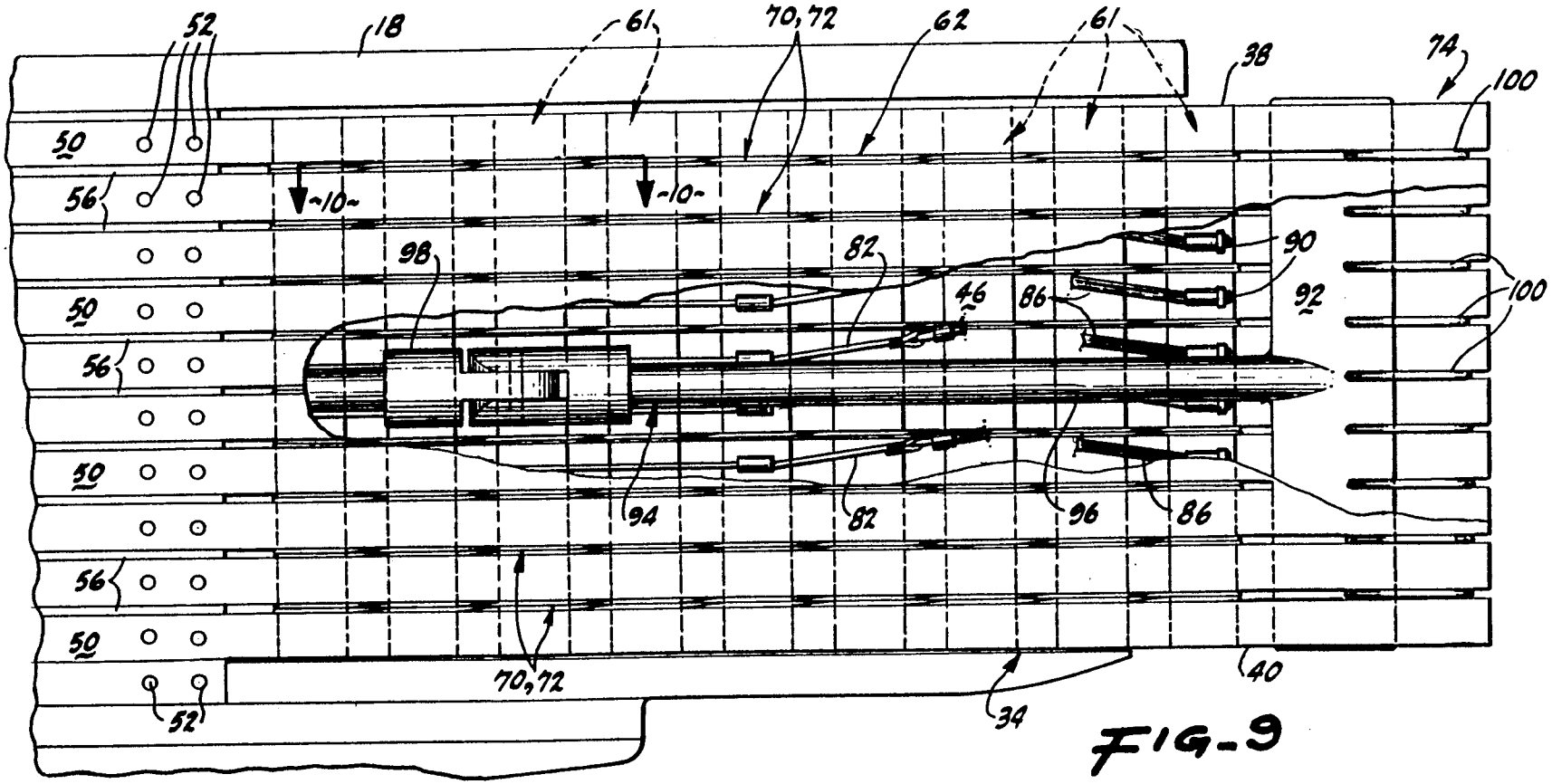
FIG. 9 is an enlarged partial side view of the rudder mechanism of the present invention found in FIG. 1 with a broken away portion depicting the interior of a chamber within the rudder mechanism.

With reference to FIGS. 9 and 10, it may be observed that a multiplicity of vertical stiffeners 60 lie against plurality of flexible strakes 48 and 50 that are held thereto by strands of line 62. For example, FIG. 10 illustrates stiffeners 64, 66, and 68 which are wrapped by criss-crossing lines 70 and 72. It should be noted that rudder apparatus 34 terminates in an end portion 74 which is positioned outwardly from water tight hull 12. In essence, rudder apparatus serves as an extension of hull 12.

Figures 7, 8, 11, 12, 13:
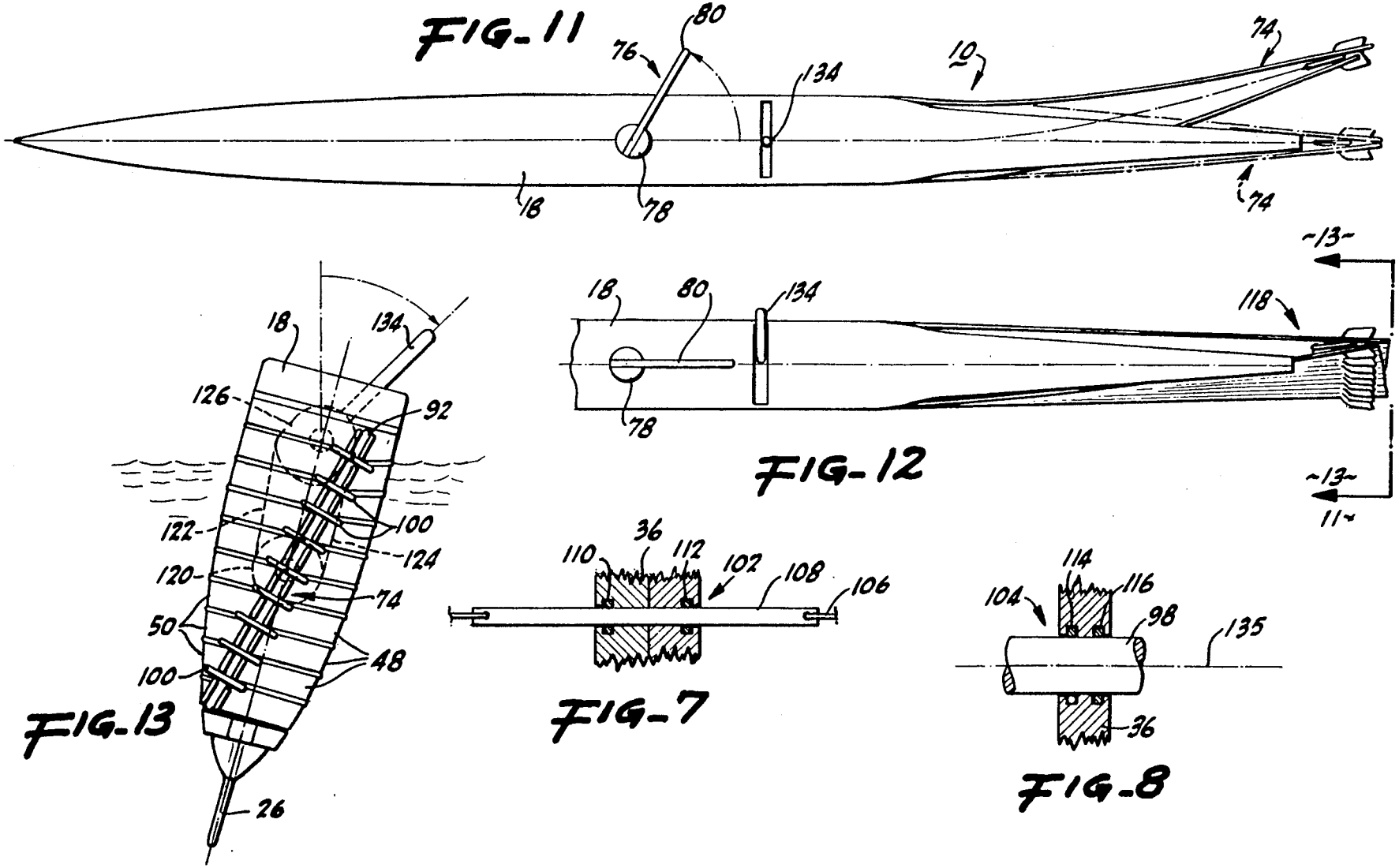
FIG. 7 is a sectional view taken along line 7—7 of FIG. 3.
FIG. 8 is a sectional view taken along line 8—8 of FIG. 3.
FIG. 11 is a schematic top plan view of the boat depicted in FIG. 2 illustrating the transverse motion of the rudder apparatus of the present invention.
FIG. 12 is a partial top schematic view of the boat depicted in FIG. 2 showing the twisting action of the rudder mechanism of the present invention.
FIG. 13 is rear end view of the rudder mechanism of the present invention depicted in FIG. 12 and taken along line 13—13 of FIG. 12.

Means 76 is depicted in the drawings for turning or flipping the end portion 74 of rudder apparatus 34 transversely relative to the hull 12. Such movement is illustrated in FIG. 11. With reference to FIG. 3, means 76 is shown as being formed by a rotating drum 78 which extends upwardly to the deck 18 of hull 12 and is provided with a lever arm 80 to effect such rotation. Lever arm 80 may be manually moved by the hand or foot of the user. In addition lever arm 80 may be motorized. A plurality of control lines or cables 82 wrap around drum 78 and extend to a plurality of flexible links 84, exemplify by flexible links 86 and 88, FIG. 3. Such pairs of flexible links cross one another and connect to multiplicity of clamps 90 which are fastened to plurality strakes 48 and 50 on side portions 42 and 44 of rudder apparatus within chamber 46. A plate 92 having an approximately ellipsoidal cross section extends through chamber 46 at end portion 74 of rudder mechanism 34. Plate 92 itself connects to an articulated shaft 94 having a transversely rotatable portion 96 and a transversely fixed portion 98. Fixed portion 98 of articulated shaft 94 is held to hull 12 by plurality of bulk heads 58. Plate 92 includes a series of fins 100, FIG. 1, which add stability to the rudder apparatus 34. Such plurality of fins 100 extend through the gaps between adjacent plurality of strakes 48 and 50 of side portions 42 and 44 of rudder apparatus 34. FIG. 7 and 8 illustrate sealing means 102 and 104 for control cables 82 and fixed portion 98 of articulated shaft 94. For example, FIG. 7 illustrates a single control cable 106 which connects to a sliding portion 108 which is water sealed by resilient rings 110 and 112 within double bulkhead 36. Similarly, shaft portion 98 is sealed by resilient rings 114 and 116.

Means 118 is also included in the present invention for turning or rotating top portion 38 and bottom portion 40 of rudder apparatus 34 transversely in opposite directions to one another. In other words end portion 74 of rudder mechanism 34 is twisted. Such twisting is effected by the use of a bushing 120 which collars fixed portion 98 of articulated shaft 94, FIG. 5. Belts 120 and 124 extend upwardly to bushing 126 which surrounds shaft 128 which is rotatably held between bulkhead 130 and 132. A lever arm 134 extends upwardly to deck 18 for manual manipulation by the user of sail boat unit 20 similarly to lever arm 80. Thus, shaft 94 is rotatable about axis 135 which extends along hull 12 as well as being capable of pivoting around pivot 136 between fixed portion 98 and transversely rotatable portion 96 of articulated shaft 94.

In operation, the user simply turns lever arm 80 to effect transverse turning of end portion 74 of rudder mechanism 34, FIG. 11. In addition, to control heeling lever arm 134 is rotating as depicted in FIG. 5 to twist end portion 74 of rudder mechanism 34 for the use of means 118, as shown in FIG. 12. Such twisting of end portion 74 tends to counteract the heel of sail boat unit 20, since the unbuoyed weight of rudder mechanism 34 is shifted opposite to the direction of heel, FIG. 13. It should be noted that rudder mechanism 34 is pervious to water and thus will lie low in a body of water which presents a low profile to any wind acting on sail boat unit 20. Floatation material such as foam plastic may be added to chamber 46 to provide a certain degree of floatation if desired.

While in the foregoing embodiments of the present invention have been set forth in considerable detail for the purposes of making a complete disclosure of the invention it may be apparent to those of skill in the art that numerous changes may be made in such details without departing from the spirit and principles of the invention.

What is claimed is:

1. A steering mechanism for a boat including a hull the improvement comprising:

a rudder apparatus directly connected to the boat hull, said rudder apparatus including an end portion positioned outwardly from the boat hull, a top portion, and a bottom portion;

b. means for turning the end portion of said rudder apparatus traversely relative to the boat hull; and c. means for turning said top portion of said rudder apparatus transversely and turning said bottom portion of said rudder apparatus traversely in a direction opposite to said transverse turning of said top portion of said rudder apparatus, to twist said rudder relative to said boat hull.

2. The steering mechanism of claim 1 in which said rudder apparatus includes a plurality of flexible strakes adjacent one another to form a first side portion, and a plurality of parallel strakes to form a second side portion, said first and second side portions each having a section lying in close proximity to one another to form said end portion of said rudder apparatus.

3. The steering mechanism of claim 2 in which further includes a plate intermediate and capable of bearing on said sections of said first and second side portions, and said means for turning said top and bottom portions of said rudder apparatus transversely and oppositely includes means for rotating said plate.

4. The steering mechanisms of claim 3 in which said means for rotating said plate includes an elongated shaft connected to said plate and means for rotating said elongated shaft about the dimension of elongation of said shaft.

5. The steering mechanism of claim 3 in which said means for turning the end portion of said rudder apparatus transversely relative to the boat hull includes an elongated shaft and further includes means for pivoting said elongated shaft transversely relative to the boat hull.

6. The steering mechanism of claim 5 in which said elongated shaft is connected to said plate.

7. The steering mechanism of claim 6 which additionally comprises means for rotating said plate further includes means for rotating said elongated shaft about the dimension of elongation.

8. The steering mechanism of claim 7 in which said elongated shaft is an articulated member having a first portion and a second portion rotatable relative to said elongated shaft first portion and rotatable transversely relative to the boat hull.

9. The steering mechanism of claim 8 in which said plurality of adjacent flexible strakes includes a plurality of fins interposed said plurality of adjacent flexible strakes and extending outwardly therefrom.

10. The steering mechanism of claim 1 in which said rudder apparatus includes a chamber within said top and bottom portions thereof.

11. The steering mechanism of claim 10 in which said chamber is pervious to water.

12. The steering mechanism of claim 10 in which at least a portion of said means for turning the end portion of said rudder apparatus lies within said chamber.

13. The steering mechanism of claim 10 in which at least a portion of said means for turning said top portion of said rudder apparatus transversely and said bottom portion of said rudder apparatus transversely in a direction opposite to said transverse turning of said top portion of said rudder apparatus lies within said chamber.

* * * * *